US007849907B2

(12) United States Patent
Jang

(10) Patent No.: US 7,849,907 B2
(45) Date of Patent: Dec. 14, 2010

(54) MULTIPLE CHOICE SHADE SYSTEM

(75) Inventor: Seong-Ryong Jang, Seoul (KR)

(73) Assignee: Wintec Korea Inc., Gyeonggi-Do (KR)

( * ) Notice: Subject to any disclaimer, the term of this patent is extended or adjusted under 35 U.S.C. 154(b) by 205 days.

(21) Appl. No.: 11/994,757

(22) PCT Filed: Jul. 5, 2006

(86) PCT No.: PCT/KR2006/002629

§ 371 (c)(1),
(2), (4) Date: Jan. 4, 2008

(87) PCT Pub. No.: WO2007/004852

PCT Pub. Date: Jan. 11, 2007

(65) Prior Publication Data

US 2008/0190569 A1 Aug. 14, 2008

(30) Foreign Application Priority Data

Jul. 5, 2005 (KR) ..... 10-2005-0060394
Jul. 25, 2005 (KR) ..... 10-2005-0067394
Jun. 29, 2006 (KR) ..... 10-2006-0059878

(51) Int. Cl.
*A47H 1/00* (2006.01)

(52) U.S. Cl. ..... 160/86; 160/89; 160/120

(58) Field of Classification Search ..... 160/85, 160/86, 89, 114, 115, 120, 241
See application file for complete search history.

(56) References Cited

U.S. PATENT DOCUMENTS 2,281,022 A * 4/1942 Cavanaugh ..... 160/85
3,980,122 A * 9/1976 Takazawa ..... 160/85
4,418,739 A * 12/1983 Woolnough et al. ..... 160/120
4,953,610 A 9/1990 Phillips et al.
5,392,549 A * 2/1995 Castro ..... 40/518
5,538,065 A * 7/1996 Geraud ..... 160/85
5,542,464 A 8/1996 Shiina
5,799,715 A 9/1998 Biro et al.
7,207,371 B2 * 4/2007 Hsu ..... 160/85
2004/0231804 A1 * 11/2004 Ward et al. ..... 160/89
2007/0084568 A1 * 4/2007 Nien ..... 160/85

(Continued)

FOREIGN PATENT DOCUMENTS

JP 10-176471 6/1998

(Continued)

*Primary Examiner*—Blair M. Johnson
(74) *Attorney, Agent, or Firm*—Rabin & Berdo, PC

(57) ABSTRACT

A multiple choice shade system includes a main frame, a first winding roller rotatably supported on the main frame, a second winding roller rotatably supported on the main frame in a spaced-apart relationship with the first winding roller, a multiple choice shade element having a succession of screen sections, and an actuator for rotating at least one of the first winding roller and the second winding roller. The shade element has a first end fixedly secured to the first winding roller and a second end fixedly secured to the second winding roller. The shade element is suspended from the first winding roller and the second winding roller in such a manner that one of the screen sections is extended into or retracted from a target area as the first winding roller and the second winding roller are rotated by the actuator.

19 Claims, 15 Drawing Sheets

U.S. PATENT DOCUMENTS

2008/0190569 A1* 8/2008 Jang ..... 160/127
2009/0173454 A1* 7/2009 Cheng ..... 160/120

FOREIGN PATENT DOCUMENTS

JP 2002-371774 12/2002
KR 20-0169334 11/1999
TW 126278 1/1990

* cited by examiner

[Fig. 1]
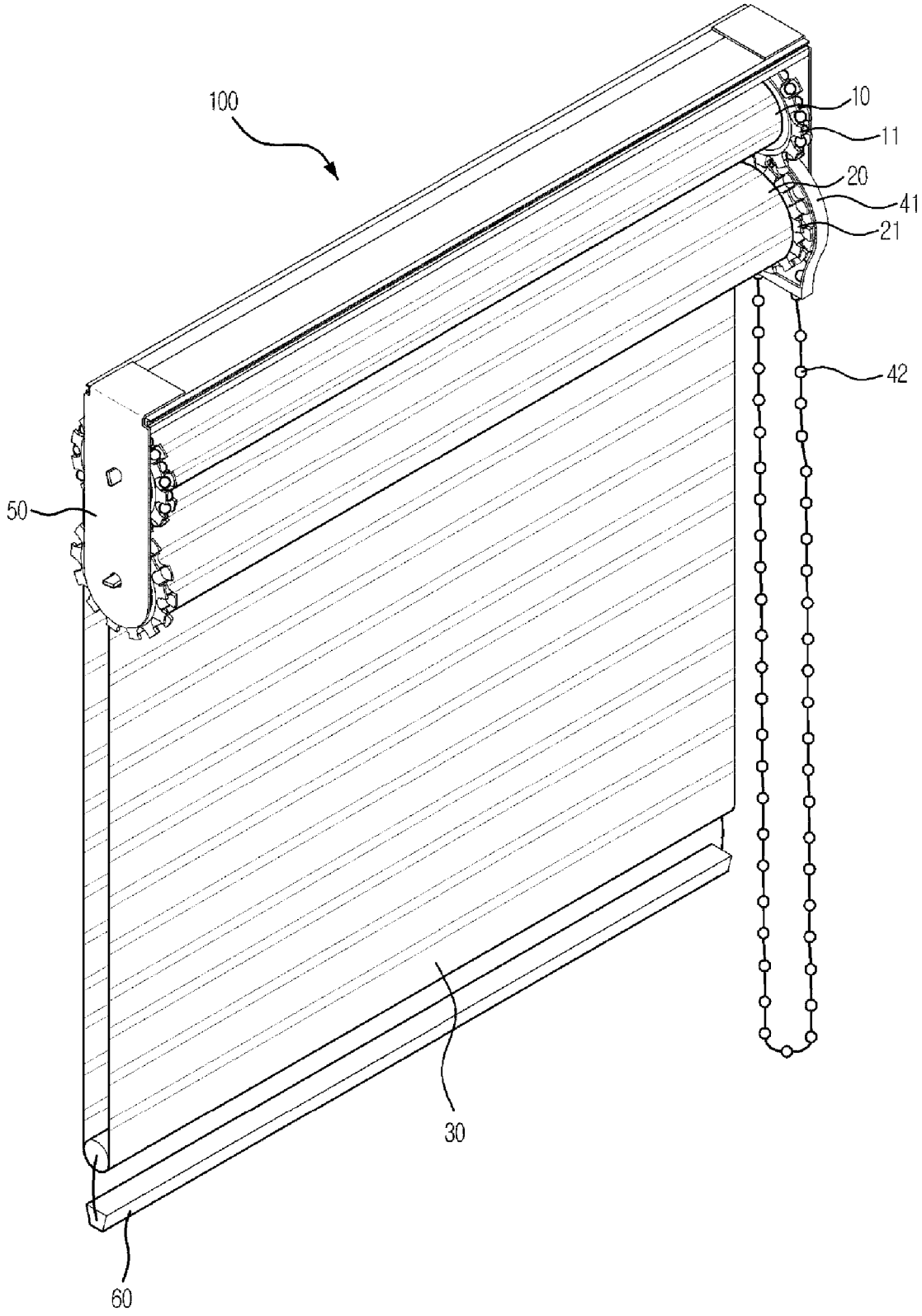

[Fig. 2]
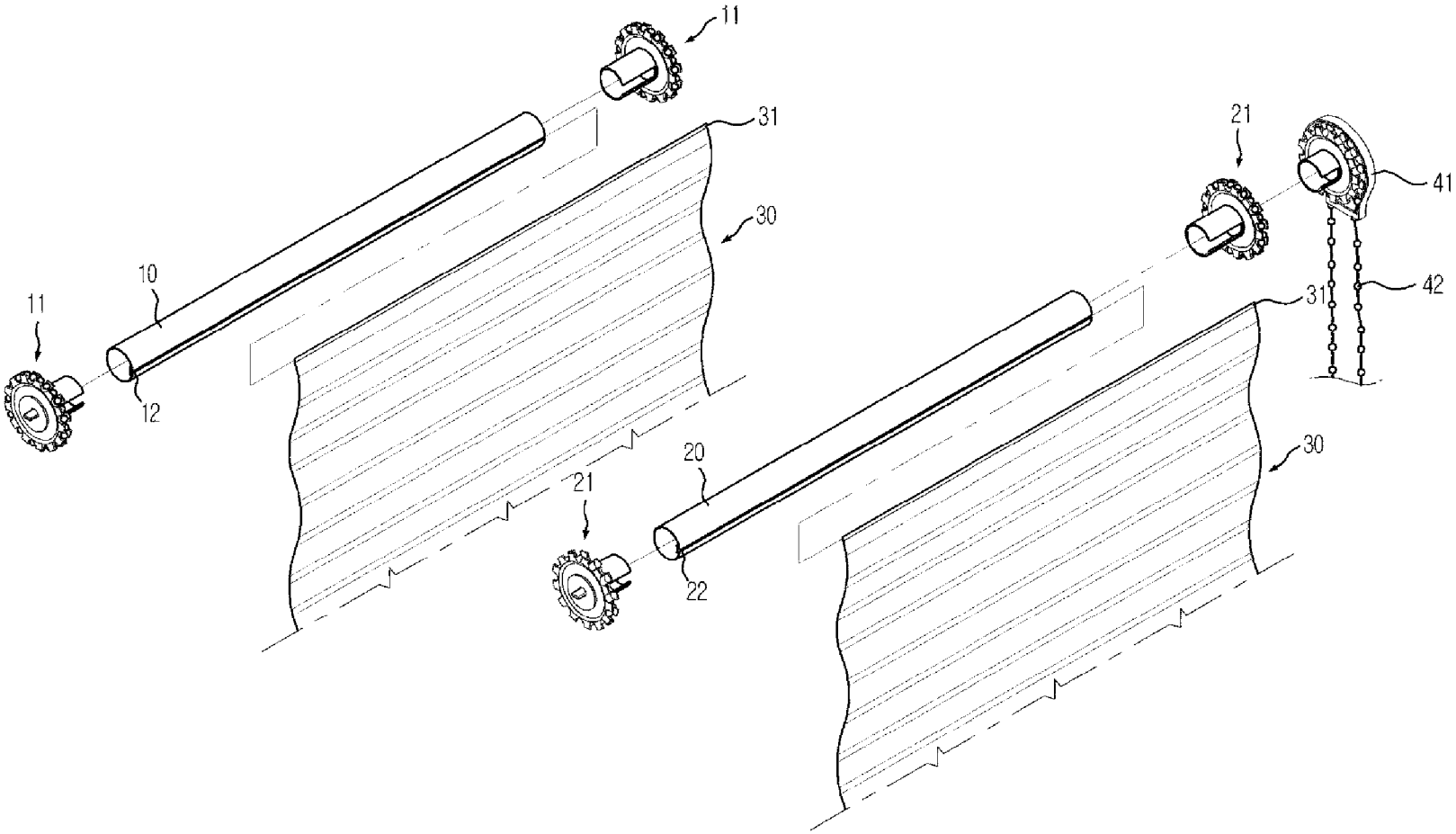

[Fig. 3]
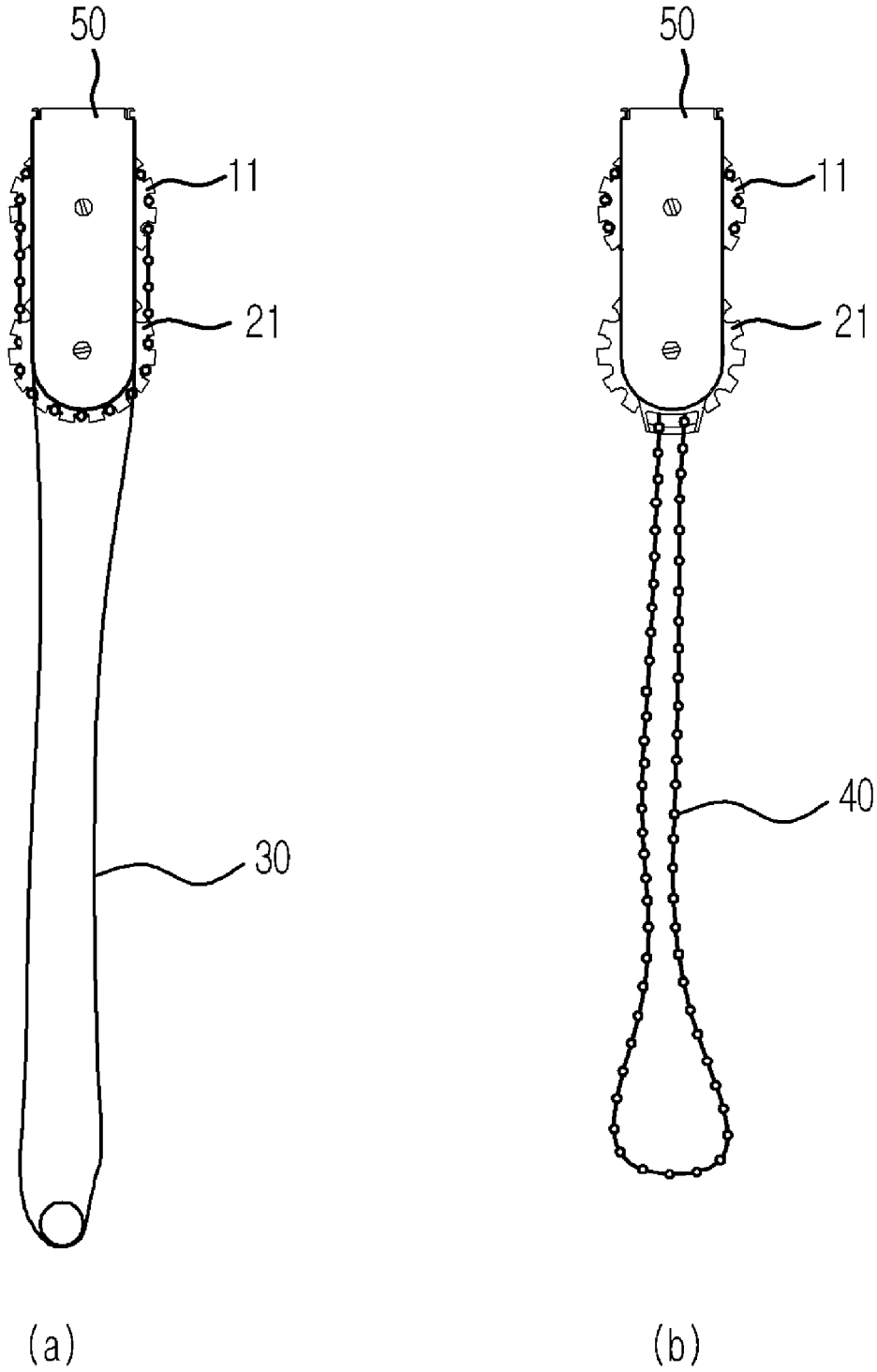

[Fig. 4]
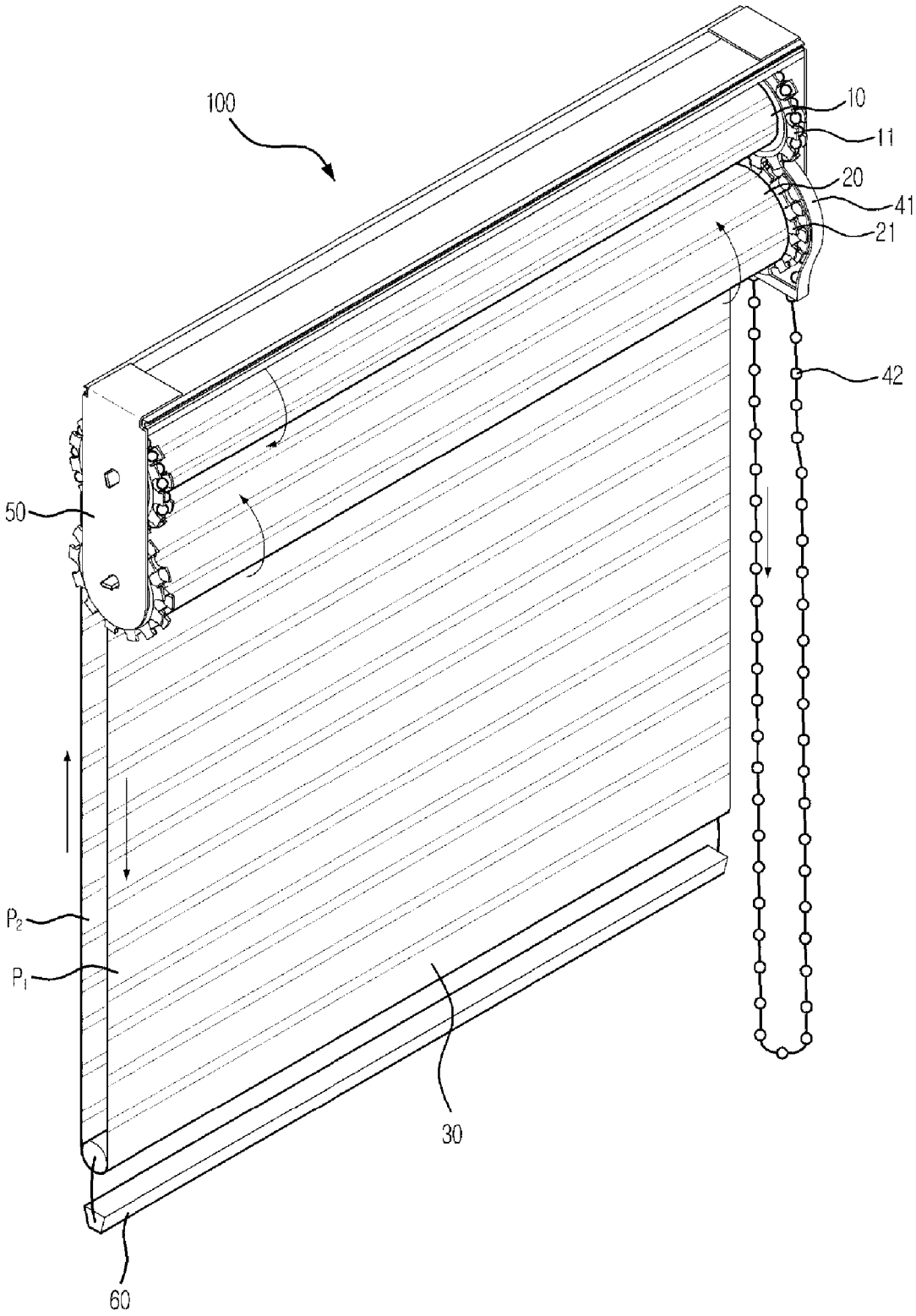

[Fig. 5]
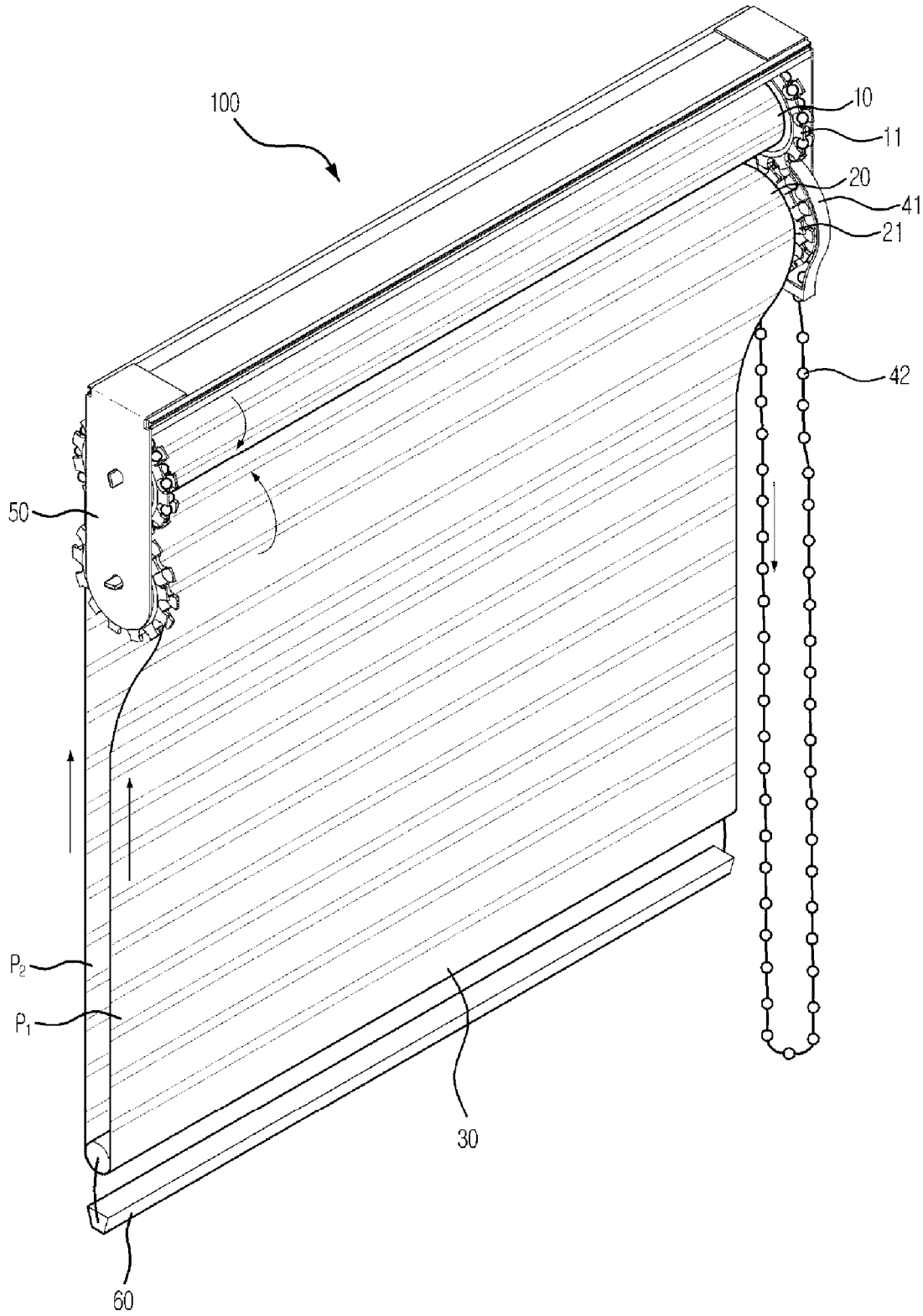

[Fig. 6]
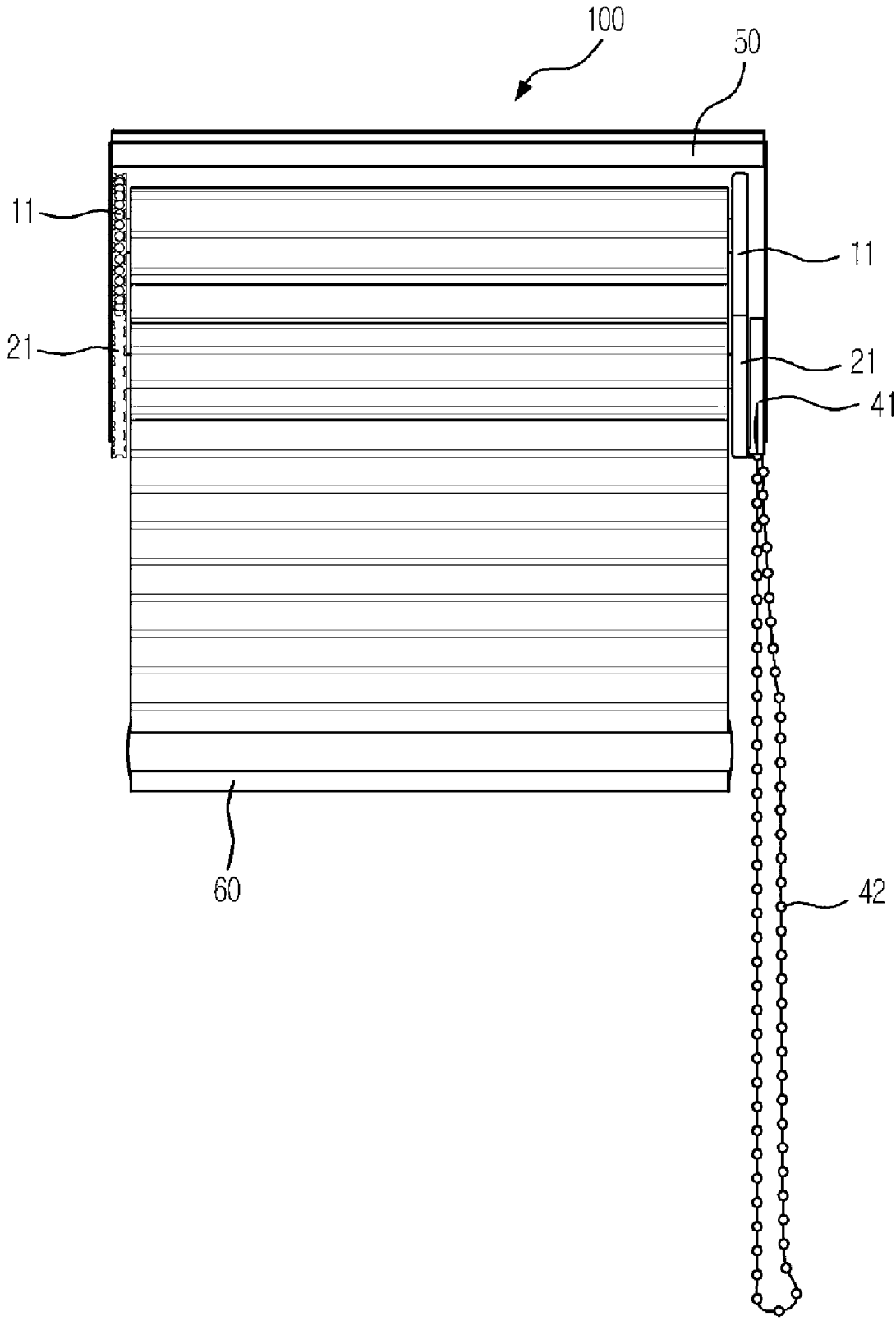

[Fig. 7]
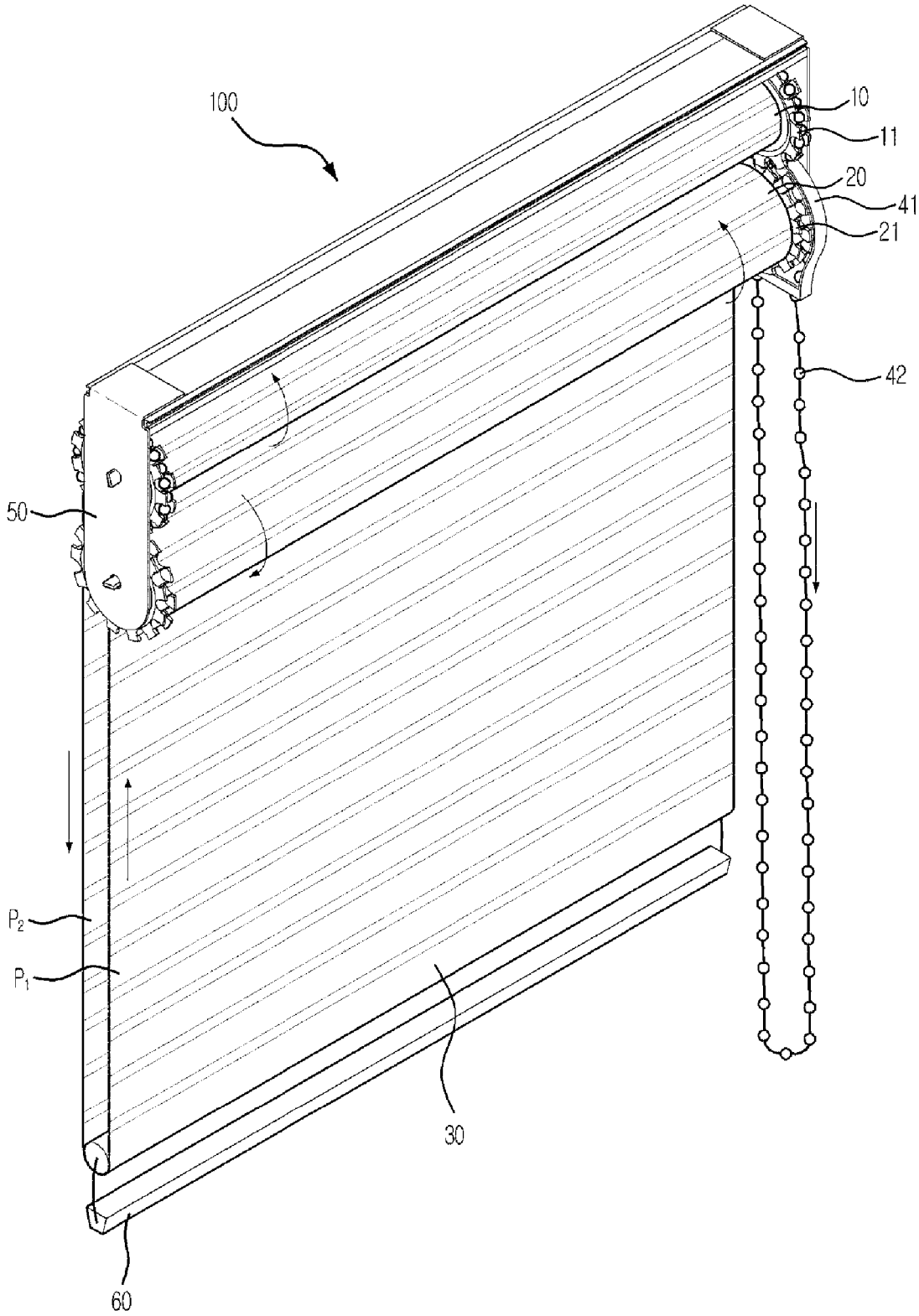

[Fig. 8]
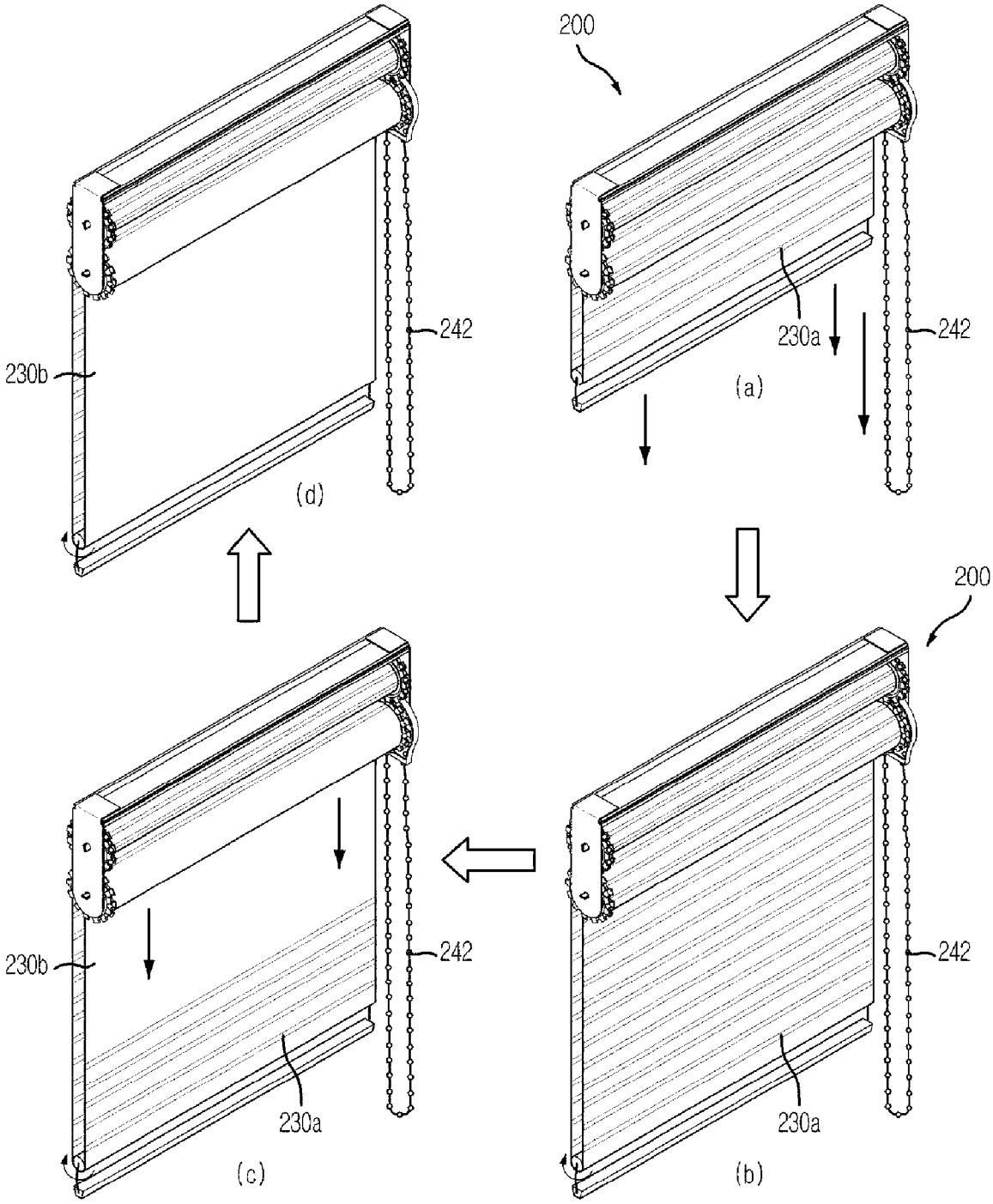

[Fig. 9]
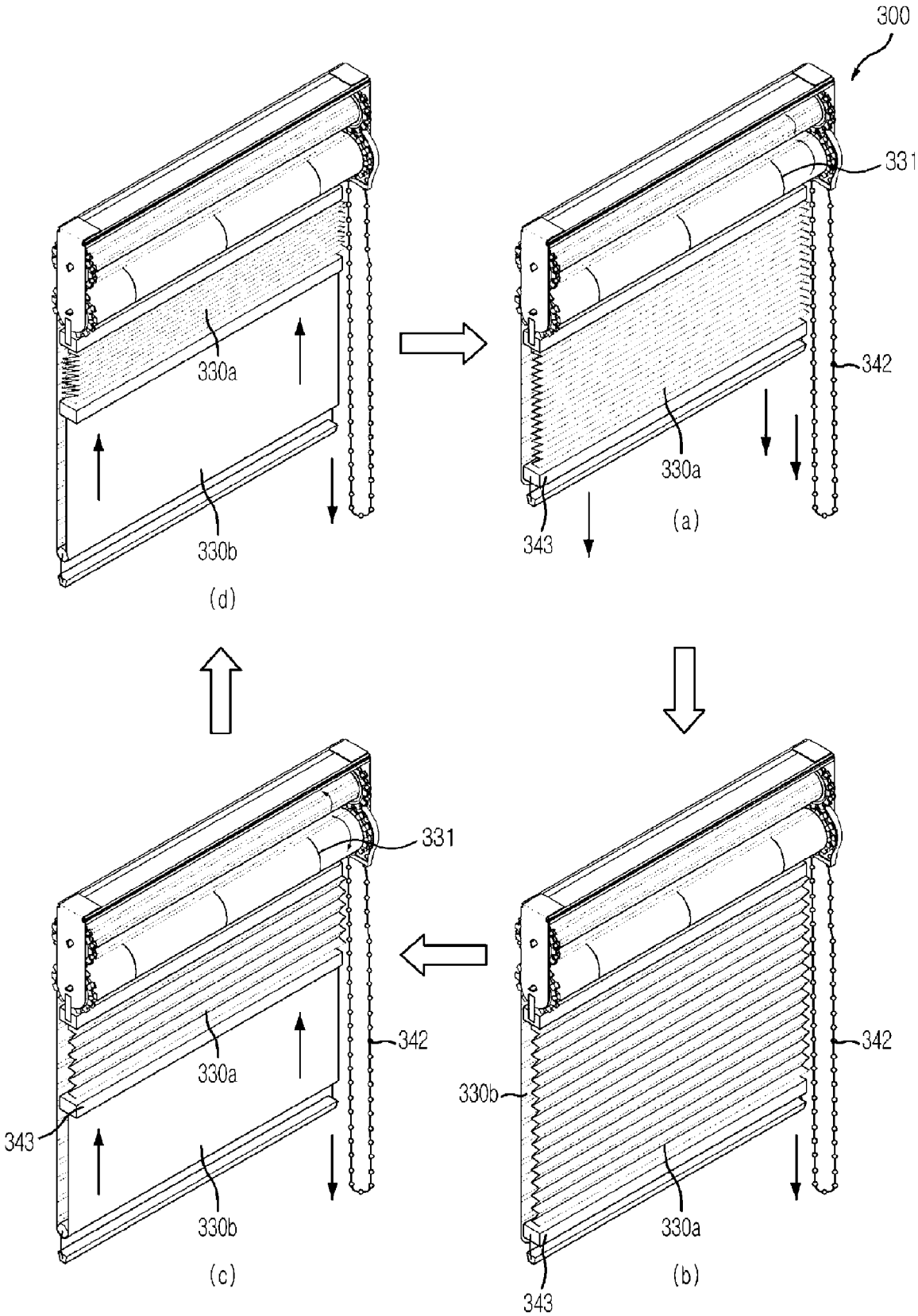

[Fig. 10]
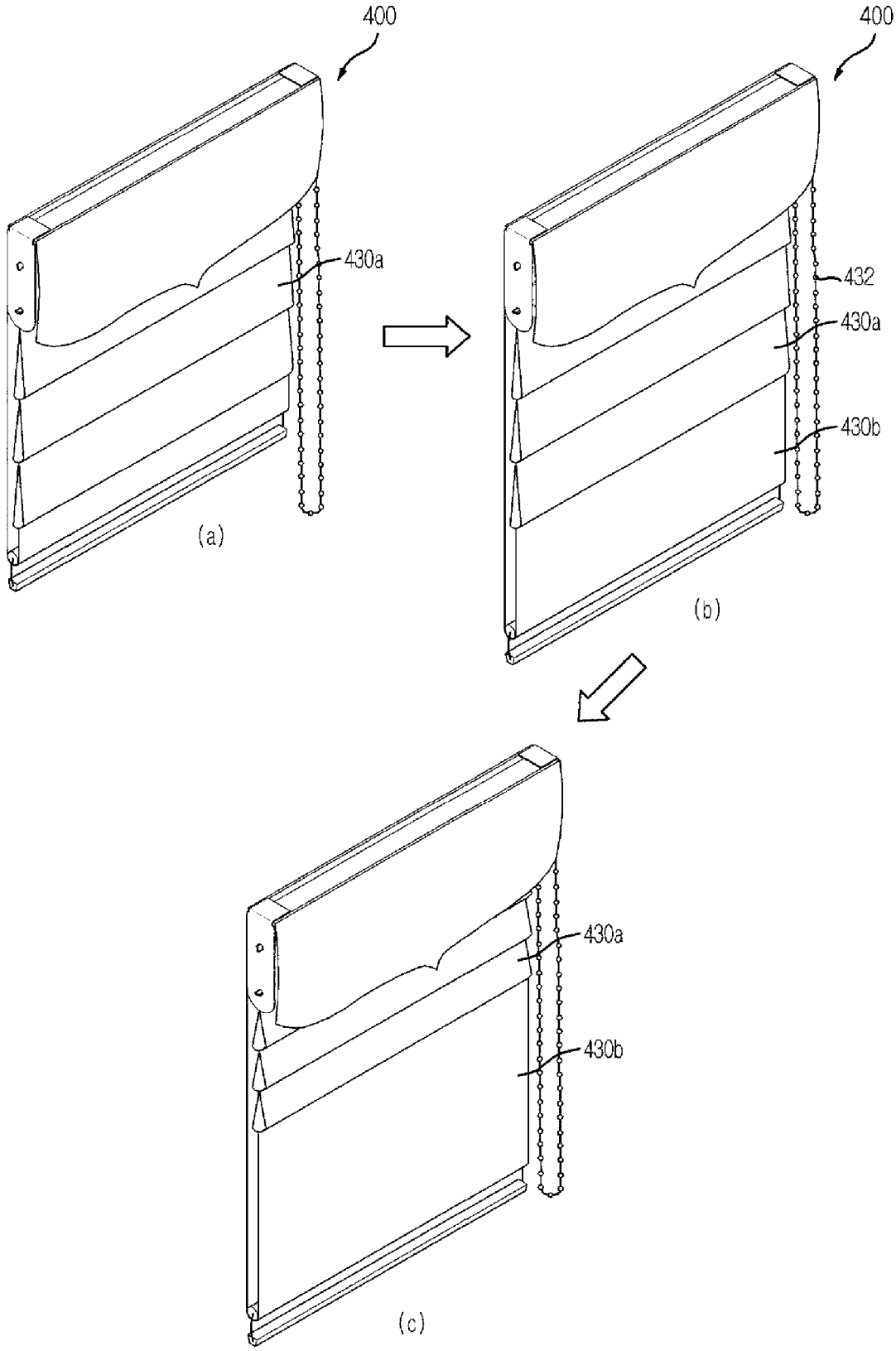

[Fig. 11]
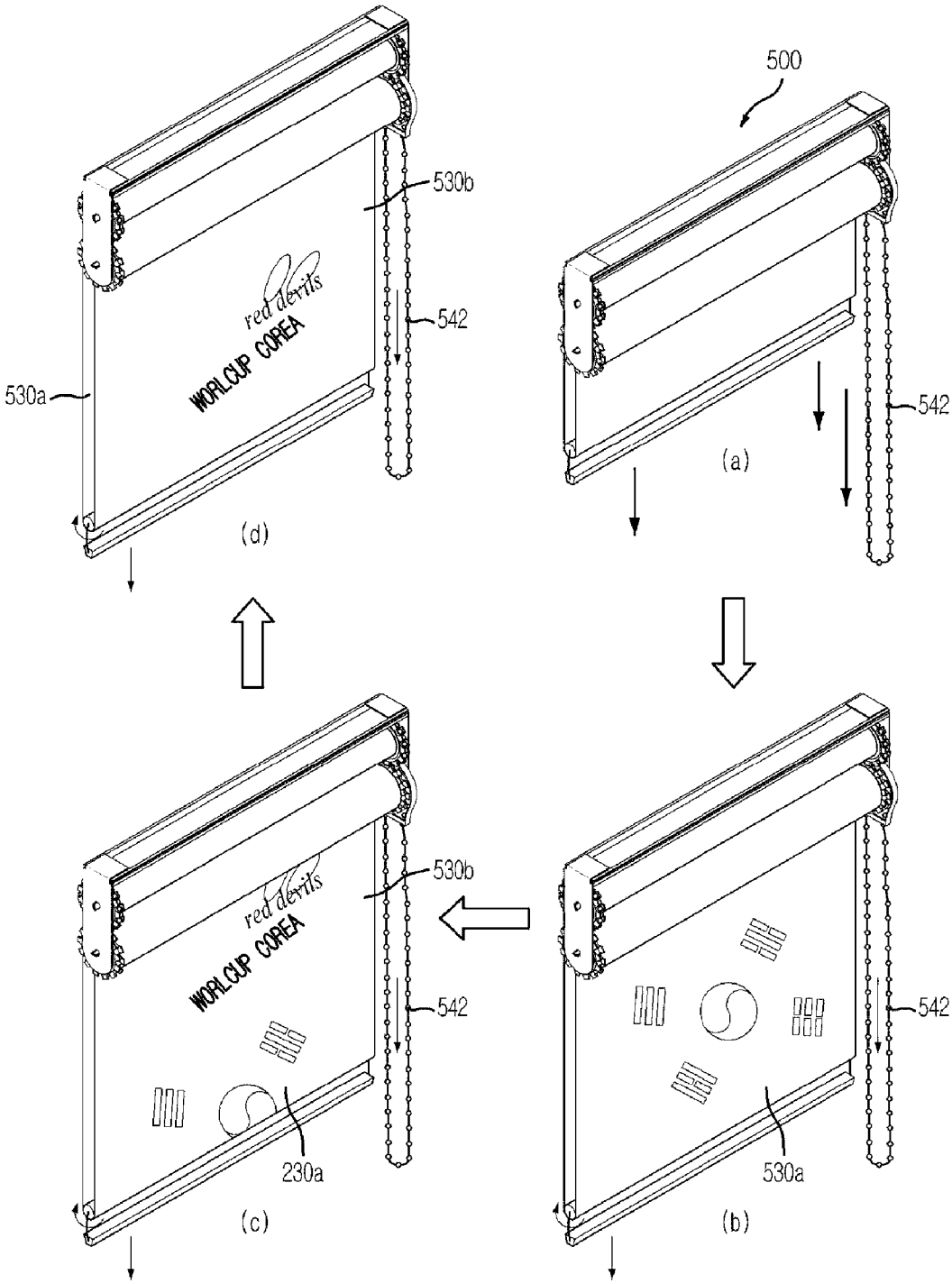

[Fig. 12]
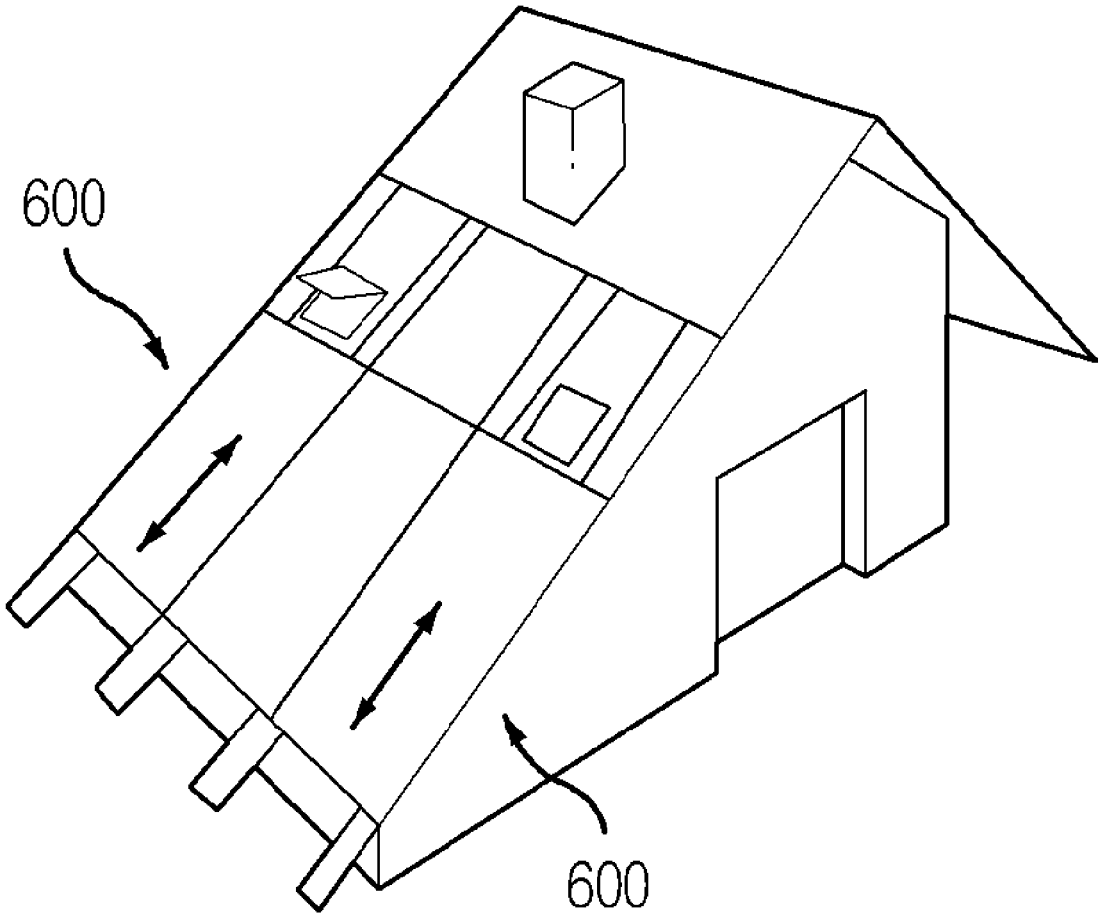

[Fig. 13]
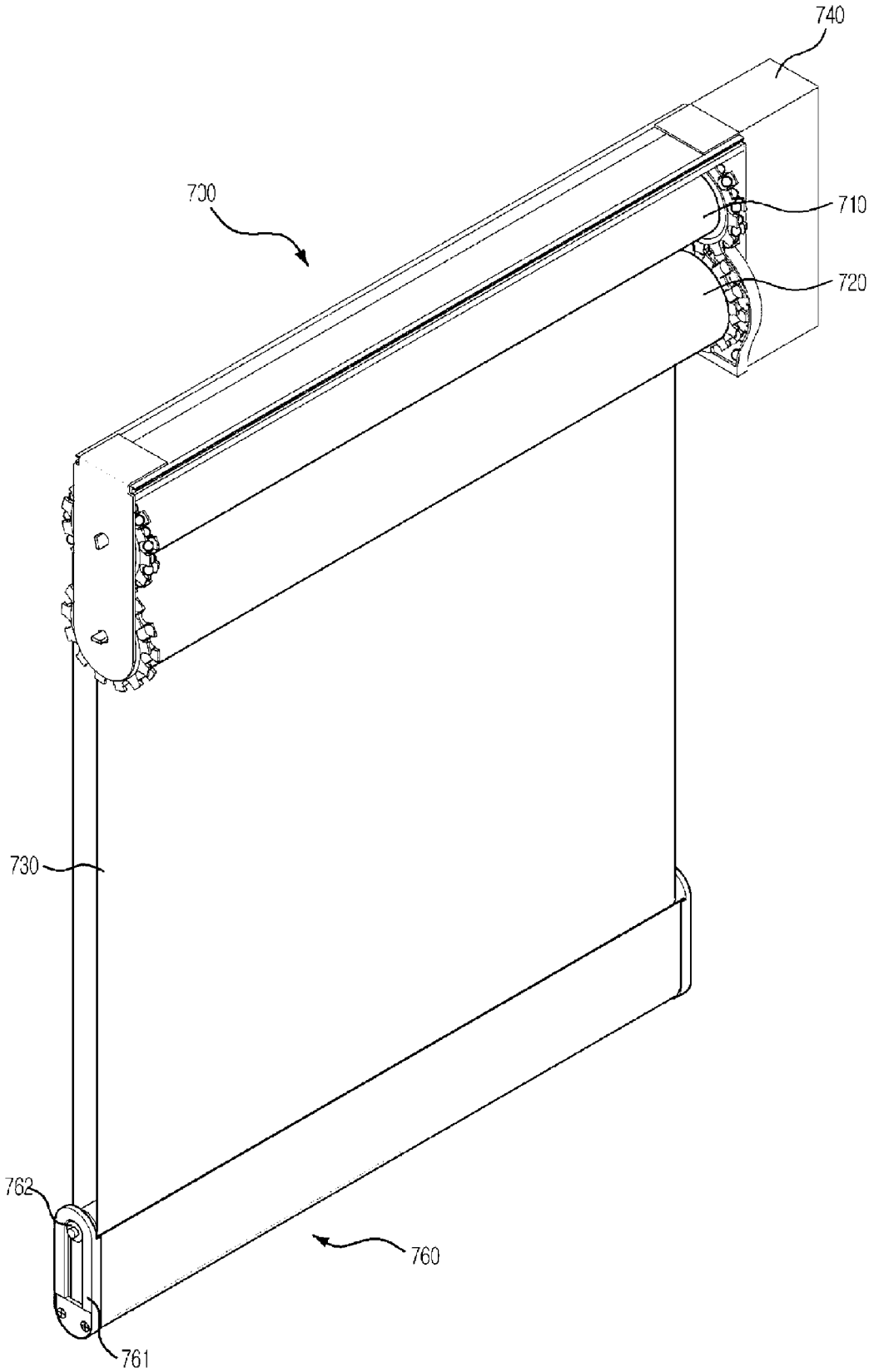

[Fig. 14]
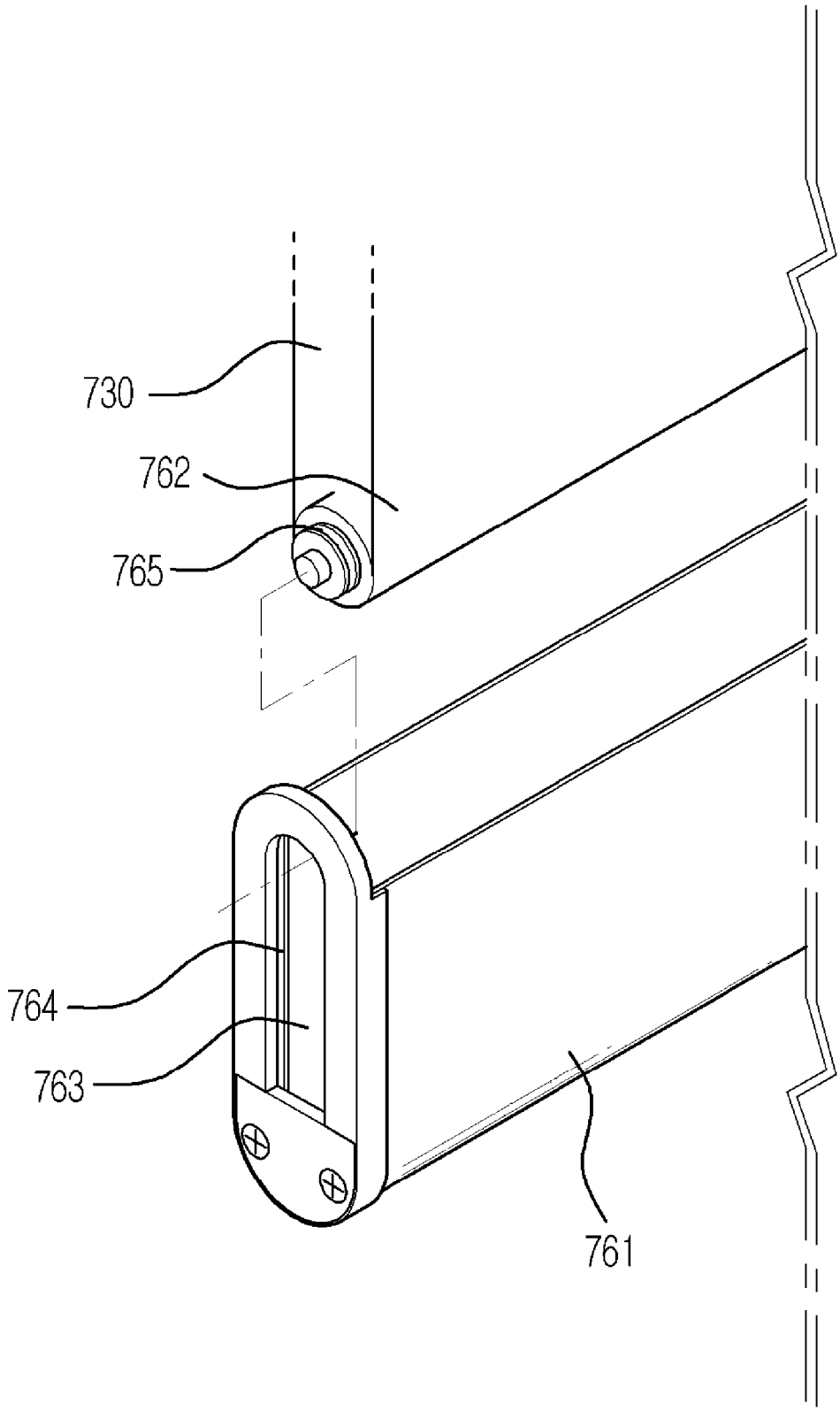

[Fig. 15]
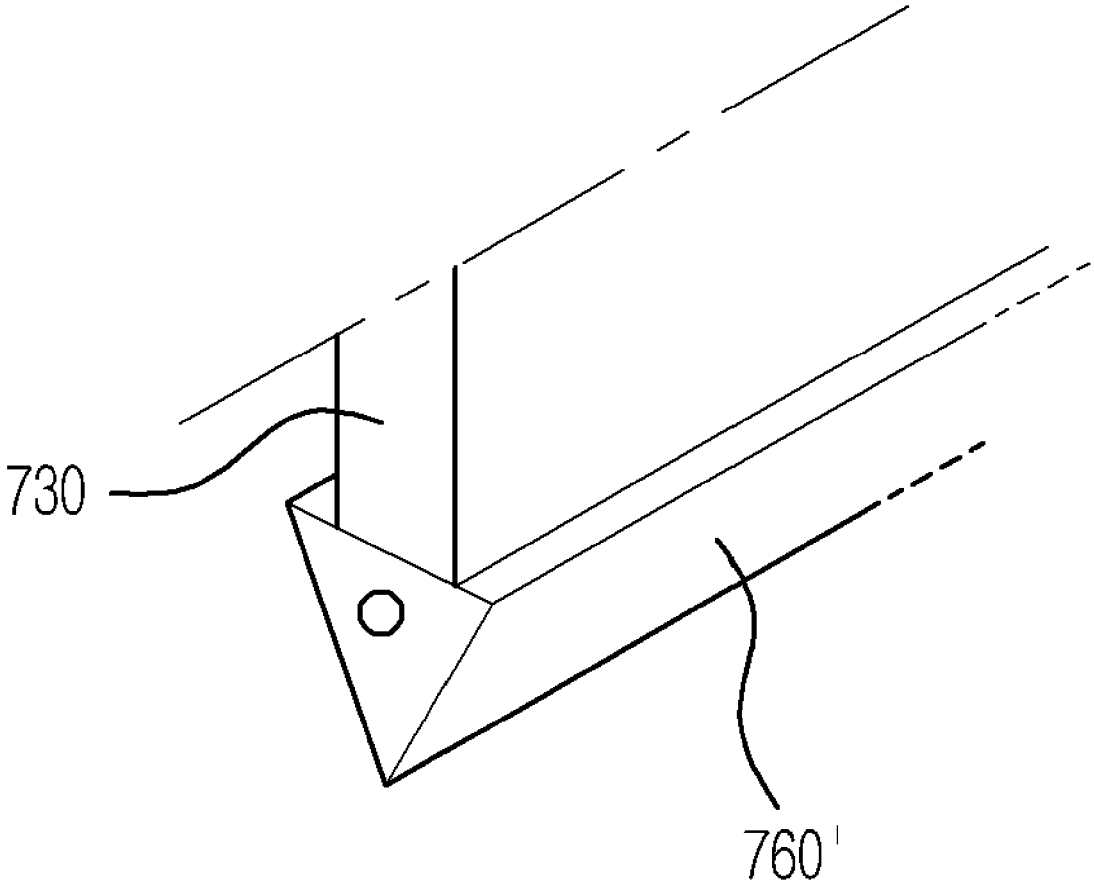

MULTIPLE CHOICE SHADE SYSTEM

FIELD OF THE INVENTION

The present invention relates to a multiple choice shade system and, more particularly, to a multiple choice shade system of the type in which a shade element having a succession of screen sections is retractably suspended from a pair of synchronously rotating rollers to shade a target area at one of the screen sections selected by a user.

BACKGROUND OF THE INVENTION

Conventionally, shade devices such as a curtain and a window blind have been used in houses or buildings for privacy protection, sun shading, heating or other purposes. Manually extending and retracting the shade devices causes inconvenience to the users. Thus, it is the recent trend to develop a variety of motorized shade systems capable of automatically raising and lowering slats through the use of an electric motor and a transmission mechanism. Appendages for such motorized shade systems, e.g., a winding device or a shading component, have been developed in varying forms.

Despite the greatly enhanced convenience in use, the conventional shade systems still fail to meet the users' need. This is particularly so in case of a shade system employing a decorative shade fabric. Because the shade fabric is composed of a single fabric sheet fixed in color, pattern or material, it should be replaced with a new one in order to satisfy a user who wishes to change the atmosphere surrounding the shade system. Replacing the shade fabric in its entirety is difficult-to-do, time-consuming and costly.

SUMMARY OF THE INVENTION

In view of the foregoing and other problems inherent in the prior art shade systems, it is an object of the present invention to provide a multiple choice shade system that allows a user to change the color, pattern or material of a shade element at any time in an easy and convenient manner.

Another object of the present invention is to provide a multiple choice shade system that enables a shade element to be rapidly extended into or retracted from a target area.

A further object of the present invention is to provide a multiple choice shade system that allows a shade element to be used as a screen for advertisement, public information, or projection, as well as for the shading purpose.

In order to achieve the above object, the present invention provides a multiple choice shade system, comprising: a main frame; a first winding roller rotatably supported on the main frame; a second winding roller rotatably supported on the main frame in a spaced-apart relationship with the first winding roller; a multiple choice shade element having a succession of screen sections, the shade element having a first end fixedly secured to the first winding roller and a second end fixedly secured to the second winding roller, the shade element extending between the first winding roller and the second winding roller in such a manner that one of the screen sections is extended into or retracted from a target area as the first winding roller and the second winding roller are rotated; and an actuator means for rotating at least one of the first winding roller and the second winding roller.

BRIEF DESCRIPTION OF THE DRAWINGS

The above and other objects and features of the present invention will become apparent from the following description of preferred embodiments, given in conjunction with the accompanying drawings, in which:

FIG. 1 is a perspective view schematically showing a multiple choice shade system in accordance with the present invention;

FIG. 2 is an exploded perspective view of the inventive multiple choice shade system shown in FIG. 1;

FIGS. 3(*a*) and 3(*b*) are left and right side elevational views of the inventive multiple choice shade system shown in FIG. 1;

FIG. 4 is a view illustrating one exemplary operation method of the inventive multiple choice shade system shown in FIG. 1;

FIG. 5 is a view illustrating another exemplary operation method of the inventive multiple choice shade system shown in FIG. 1;

FIG. 6 is a view illustrating a further exemplary operation method of the inventive multiple choice shade system shown in FIG. 1;

FIG. 7 is a front elevational view of the inventive multiple choice shade system shown in FIG. 1;

FIGS. 8(*a*) through 8(*d*) are views showing the configuration and operation method of a first modification of the multiple choice shade system in accordance with the present invention;

FIGS. 9(*a*) through 9(*d*) are views showing the configuration and operation method of a second modification of the multiple choice shade system in accordance with the present invention;

FIGS. 10(*a*) through 10(*c*) are views showing the configuration and operation method of a third modification of the multiple choice shade system in accordance with the present invention;

FIGS. 11(*a*) through 11(*d*) are views showing the configuration and operation method of a fourth modification of the multiple choice shade system in accordance with the present invention;

FIG. 12 is a view showing the configuration and operation method of a fifth modification of the multiple choice shade system in accordance with the present invention;

FIG. 13 is a view showing the configuration and operation method of a sixth modification of the multiple choice shade system in accordance with the present invention;

FIG. 14 is a partially cut-away exploded perspective view illustrating a bottom weight member of the multiple choice shade system shown in FIG. 13; and FIG. 15 is a partially cut-away exploded perspective view illustrating an alternative bottom weight member of the multiple choice shade system in accordance with the present invention.

DETAILED DESCRIPTION OF THE INVENTION

A multiple choice shade system in accordance with the present invention will now be described with reference to the accompanying drawings.

FIGS. 1, 2, 3(*a*) and 3(*b*) are a perspective view, an exploded perspective view, and left and right side elevational views schematically showing a multiple choice shade system in accordance with the present invention. FIG. 7 is a front elevational view of the multiple choice shade system shown in FIG. 1.

Referring to FIGS. 1, 2, 3(*a*), 3(*b*) and 7, the multiple choice shade system 100 of the present invention includes a main frame 50, a first winding roller 10 rotatably supported on the main frame 50, a second winding roller 20 rotatably supported on the main frame 50 in a spaced-apart relationship with the first winding roller 10 and operatively connected to the first winding roller 10 for rotation therewith, a multiple choice shade element 30 extending between the first winding roller 10 and the second winding roller 20, and an actuator means for rotating the first winding roller 10 and the second winding roller 20 in such a manner that one of the screen sections of the shade element 30 can be extended into or retracted from a target area to be shaded.

First gears 11 are fixedly secured to the axial opposite ends of the first winding roller 10. Alternatively, a single first gear may be provided on one axial end of the first winding roller 10. The first winding roller 10 has an axially extending slot 12 to which one fixed end 31 of the multiple choice shade element 30 is insertedly fastened.

Fixedly secured to the axial opposite ends of the second winding roller 20 are second gears 21 respectively meshed with the corresponding one of the first gears 11 for synchronous rotation therewith in a reverse direction. Alternatively, a single second gear may be provided on one axial end of the second winding roller 20. The second winding roller 20 has an axially extending slot 22 to which the other fixed end 31 of the multiple choice shade element 30 is insertedly fastened.

In place of the first gears 11 and the second gears 21, other transmission mechanisms such as a chain-sprocket combination, a belt-pulley combination and the like may be employed as a means for operatively connecting the first winding roller 10 and the second winding roller 20. It is preferred the first gears 11 and the second gears 21 are comprised of chain wheels around which a ball chain or ball cord can be wound.

The multiple choice shade element 30 is of an elongated strip shape and has a succession of screen sections arranged in a longitudinal direction of the shade element 30 in an end-to-end relationship. One of the screen sections is selected at the user's desire and retractably extended into a target area by operating the first winding roller 10 and the second winding roller 20 in the manner as set forth later. The multiple choice shade element 30 is made of a variety of fabrics, including for example an opaque fabric, a transparent fabric, a mixture of the opaque fabric and the transparent fabric, a patterned fabric, a color fabric and an advertisement-design-containing fabric. As used herein, the term "fabric" includes papers, textiles and other like materials conventionally used for shading purpose.

One fixed end 31 of the multiple choice shade element 30 is insertedly fastened to the axially extending slot 12 of the first winding roller 10, while the other fixed end 31 of the multiple choice shade element 30 is insertedly fastened to the axially extending slot 22 of the second winding roller 20. The multiple choice shade element 30 has an intermediate portion that is suspended from the first winding roller 10 and the second winding roller 20 to form a generally U-shaped loop.

Through arbitrary combination of the continuously-formed screen sections, the multiple choice shade element 30 may be formed have a length, e.g., 2.5 times, 3 times or 4 times as great as the length of the target area to be shaded. The multiple choice shade element 30 thus formed is rolled up onto or unrolled from the first winding roller 10 and the second winding roller 20 to extend one of the screen sections over the target area. This enables a user to change the light transmittance, color, pattern or the like of the multiple choice shade element 30 at his or her choice.

The actuator means is utilized in rotating the first winding roller 10 and the second winding roller 20 to thereby adjust the winding amount, unwinding amount and extension length of the multiple choice shade element 30. The actuator means is comprised of a rotating member 41 and a pull cord 42. The rotating member 41 is preferably formed of a chain wheel and attached to the second winding roller 20 in the embodiment shown in the drawings. Alternatively, the rotating member 41 may be secured to the first winding roller 10, one of the first gears 11 or one of the second gears 21. The pull cord is formed of a ball chain and engages with the rotating member 41 in such a manner that the rotating member 41 can be rotated as the pull cord 42 is pulled down.

The multiple choice shade system further includes a weighted guide member 60 hung from the bottom portion of the multiple choice shade element 30. The weighted guide member 60 serves to apply tensile force to the shade element 30 while allowing the shade element 30 to slidingly move through the same. This enables the shade element 30 to be unrolled down or rolled up in a wrinkle-free manner, thus assuring effective extension and retraction of the shade element 30.

With the multiple choice shade system of the configuration set forth above, the user can selectively extend one of the screen sections of the multiple choice shade element 30 into the target area, e.g. over a window, and further can change the currently displayed screen section to a new one at any time.

Next, description will be given to the operation of the multiple choice shade system with reference to FIGS. 4, 5 and 6, which illustrate exemplary operation methods of the inventive multiple choice shade system.

In the multiple choice shade system 100, if the rear run portion of the pull cord 42 of the actuator means is pulled downwardly as indicated by an arrow in FIG. 4, the second winding roller 20 is rotated counterclockwise as view from the left side. In response, the first winding roller 10 is turned clockwise, because the first winding roller 10 remains directly meshed with the second winding roller 20. In this process, the portion P1 of the shade element 30 wound on the second winding roller 20 is unrolled therefrom and extended downwardly, while the portion P2 of the shade element 30 already extended is retracted upwardly and rolled onto the first winding roller 10. As the shade element 30 is synchronously unrolled and rolled as indicated by arrows in FIG. 4, the presently displayed screen section of the shade element 30 is removed from the target area and a new screen section is extended from the second winding roller 20 to shade the target area. Once the new screen section is fully extended from the second winding roller 20 into the target area, the user releases the pull cord 42 to keep the new screen section in that position.

Conversely, if the front run portion of the pull cord 42 of the actuator means is pulled downwardly as indicated by an arrow in FIG. 5, the second winding roller 20 is rotated clockwise as view from the left side. In response, the first winding roller 10 is turned counterclockwise, because the first winding roller 10 remains directly meshed with the second winding roller 20. In this process, the portion P2 of the shade element 30 wound on the first winding roller 10 is unrolled therefrom and extended downwardly, while the portion P1 of the shade element 30 already extended is retracted upwardly and rolled onto the second winding roller 20. As the shade element 30 is synchronously unrolled and rolled in the reverse direction as indicated by arrows in FIG. 5, the presently displayed screen section of the shade element 30 is removed from the target area and a new screen section is extended from the first winding roller 10 to shade the target area. Once the new screen section is fully extended from the first winding roller 10 into the target area, the user releases the pull cord 42 to keep the new screen section in that position.

In this way, the user can select and bring into a shading position one of the continuously-formed screen sections of the multiple choice shade element 30. In case where the multiple choice shade element 30 consists of alternately arranged transparent and opaque stripes as illustrated in FIGS. 1 through 7, the light is transmitted in a stripe pattern, thereby making it possible to use the multiple choice shade system as a decorative display screen in a performance hall or the like.

The multiple choice shade element 30 may have a succession of differently-looking screen sections that provide an advertisement effect or an information notification effect, in addition to the intrinsic shading effect. It will be apparent to those skilled in the art that the color, pattern or material of the screen sections of the shade element may be modified in many different ways and such modifications should fall within the scope of the present invention.

In the meantime, if the rear run portion of the pull cord 42 of the actuator means is continuously pulled in the direction as indicated by an arrow in FIG. 4 to rotate the second winding roller 20 counterclockwise as view from the left, the shade element 30 is finally unrolled from the second winding roller 20 in its entirety and, in turn, begins to be rolled onto the second winding roller 20 in the reverse direction as illustrated in FIG. 6. Thus, the parallel extension portions P1 and P2 of the shade element 30 are all rolled onto the first winding roller 10 and the second winding roller 20. This lifts up the shade element 30 together with the weighted guide member 60 into a completely retracted position. If the front run portion of the pull cord 42 is pulled downwardly in this condition, the first winding roller 10 and the second winding roller 20 are rotated clockwise. In response, the shade element 30 is synchronously unrolled from the first winding roller 10 and the second winding roller 20 and extended toward a fully extended position which is set in advance by properly selecting the initial winding amount of the shade element 30. Upon arrival at the fully extended position, the shade element 30 begins to be rolled onto the second winding roller 20, at which time the shade element 30 continues to be unrolled from the first winding roller 10 as illustrated in FIG. 5. This makes it possible to extend a new screen section of the shade element 30 wound on the first winding roller 10 into the target area to be shaded.

Alternatively, the tasks of extending and retracting the shade element 30 into and from the target area may be performed by continuously pulling the front run portion of the pull cord 42 and not the rear run portion. In this regard, description will be offered later with reference to FIG. 8.

It will be apparent to those skilled in the art that the length and winding amount of the multiple choice shade element 30 may be set in many different ways and such modifications should fall within the scope of the present invention.

As described above, the multiple choice shade system of the present invention allows the user to shade a target area with one of screen sections of the shade element 30, which can be selected at the user's desire by pulling the pull cord 42 and thus rotating the first winding roller 10 and the second winding roller 20 together. Furthermore, the shade element 30 can be rapidly extended into or retracted from the target area through the synchronous operation of the first winding roller 10 and the second winding roller 20.

Turning now to FIGS. 8(*a*) through 8(*d*), there is shown the configuration and operation method of a first modification of the multiple choice shade system in accordance with the present invention. The multiple choice shade system 200 of this modification has the same configuration as that of the embodiment described above, except that the shade element consists of a first stripe-patterned screen section 230*a* and a second pattern-free screen section 230*b*.

FIG. 8(*a*) shows an initial shade-element-extending stage at which the first screen section 230 begins to be extended downwardly as the pull cord 242 is pulled down to rotate the first winding roller and the second winding roller. FIG. 8(*b*) illustrates the first screen section 230 fully extended over the target area and kept tensioned by the weighted guide member. FIG. 8(*c*) depicts the condition that the second pattern-free screen section 230*b* is unrolled halfway from the second winding roller as the pull cord 242 is further pulled down. FIG. 8(*d*) represents the state that the first stripe-patterned screen section 230*a* is rolled on the first winding roller and the second pattern-free screen section 230*b* is fully extended over the target area. It should be noted that the number and kind of the screen sections in this modification is not particularly limited to the ones illustrated but may be replaced with other ones depending on the application of the multiple choice shade system and the user's desire.

Referring to FIGS. 9(*a*) through 9(*d*), there is shown the configuration and operation method of a second modification of the multiple choice shade system in accordance with the present invention. The multiple choice shade system 300 of this modification has the same configuration as that of the first modification, except that the shade element consists of a pleated screen section 330*a* and a planar screen section 330*b*. The pleated screen section 330*a* has a bottom frame 343 which in turn is connected to a winding wire 331 wound on the second winding roller.

FIG. 9(*a*) shows an initial shade-element-extending stage at which the winding wire 331 connected to the bottom frame 343 is unrolled from the second winding roller and the pleated screen section 330*a* begins to be extended downwardly, as the pull cord 342 is pulled down in the direction indicated by an arrow to rotate the first winding roller and the second winding roller. FIG. 9(*b*) illustrates the pleated screen section 330*a* fully extended over the target area and kept tensioned by the weighted guide member. FIG. 9(*c*) depicts the condition that the winding wire 331 is rolled onto the second winding roller and the pleated screen section 330*a* begins to be retracted upwardly, as the pull cord 342 is further pulled down. At this time, the planar screen section 330*b* is unrolled from the first winding roller and extended halfway over the target area together with the pleated screen section 330*a*. FIG. 9(*d*) represents the state that the pleated screen section 330*a* is fully retracted toward the second winding roller and the planar screen section 330*b* is fully extended over the target area.

Referring to FIGS. 10(*a*) through 10(*c*), there is shown the configuration and operation method of a third modification of the multiple choice shade system in accordance with the present invention. The multiple choice shade system 400 of this modification has the same configuration as that of the first modification, except that the shade element consists of a Roman screen section 430*a* and a planar screen section 430*b*. The user can selectively extend one of the Roman screen section 430*a* and the planar screen section 430*b* into the target area by pulling down the pull cord 432.

FIG. 10(*a*) illustrates the Roman screen section 430*a* fully extended over the target area and kept tensioned by the weighted guide member. FIG. 10(*b*) depicts the condition that the Roman screen section 430*a* begins to be retracted upwardly, as the pull cord 432 is further pulled down. At this time, the planar screen section 430*b* is unrolled from the first winding roller and extended halfway over the target area together with the Roman screen section 430*a*. FIG. 10(*c*) represents the state that the Roman screen section 430*a* is fully retracted toward the second winding roller and the planar screen section 430*b* is fully extended over the target area.

Referring to FIGS. 11(*a*) through 11(*d*), there is shown the configuration and operation method of a fourth modification of the multiple choice shade system in accordance with the present invention. The multiple choice shade system 500 of this modification has the same configuration as that of the first modification, except that the shade element consists of a first emblem-printed screen section 530*a* and a second catchword-printed screen section 530*b*. The user can selectively extend one of the first emblem-printed screen section 530*a* and the second catchword-printed screen section 530*b* into the target area by pulling down the pull cord 532. This enables the shade element to be used for the purpose of public information or advertisement.

FIG. 11(*a*) shows an initial shade-element-extending stage at which the shade element begins to be extended downwardly as the pull cord 542 is pulled down to rotate the first winding roller and the second winding roller. FIG. 11(*b*) illustrates the first emblem-printed screen section 530*a* fully extended over the target area and kept tensioned by the weighted guide member. FIG. 11(*c*) depicts the condition that the second catchword-printed screen section 530*b* is unrolled halfway from the second winding roller as the pull cord 542 is further pulled down. FIG. 11(*d*) represents the state that the second catchword-printed screen section 530*b* is fully extended over the target area. This allows the user to use the shade element for the purpose of public information or advertisement at his or her choice. The first and second screen sections may contain an emblem and a catchword printed in a mutually inverted relationship so that the viewers can correctly observe the emblem and the catchword at both sides of the multiple choice shade system. If needed, an electric motor and a controller may be further provided to automatically change the screen sections at a predetermined time interval.

Referring to FIG. 12, there is shown the configuration and operation method of a fifth modification of the multiple choice shade system in accordance with the present invention. As shown, the multiple choice shade system 600 of this modification can be used as a fabric tension system ("FTS").

The fabric tension system is referred to as a roof-type shade or blind and has been developed for use with a slant window or a horizontal roof. The fabric tension system includes a couple of electric motors that are arranged at the opposite ends of a fabric to prevent sagging of the fabric. Such a fabric tension system is used to shield ultraviolet rays and solar heat in a slant window, a horizontal window, a roof window, a curved window or other special windows rather than a typical vertical window. The electric motors serve to tightly pull the fabric at its opposite ends, and the tensile force generated at this time is controlled by means of a controller. If the present invention is applied to the fabric tension system, the multiple choice shade system 600 can be embodied with a single electric motor, which helps to reduce the costs in fabricating the shade system. Furthermore, it becomes possible to selectively use more than two different fabrics in a single shade system.

FIG. 13 is a view showing the configuration and operation method of a sixth modification of the multiple choice shade system in accordance with the present invention, and FIG. 14 is a partially cut-away exploded perspective view illustrating a bottom weight member of the multiple choice shade system shown in FIG. 13. As illustrated, the multiple choice shade system 700 of this modification has the same configuration as that of the first modification, except that a motor unit 740 is further provided to rotate the first winding roller 710 and the second winding roller 720 in a controlled manner and further that a bottom weight member 760 differing in structure from the weighted guide member is employed.

The motor unit 740 is used to extend and retract the shade element with an electric power and includes an electric motor and a remote controller. The bottom weight member 760 is comprised of a guide rod 762 and a suspending body 761 hung on the guide rod 762. The guide rod 762 is placed on the U-shaped bottom end of the shade element 730 and functions to exert a tensile force to the shade element 730, thus allowing it to be extended, retracted and rolled in a wrinkle-free manner. The guide rod 762 is provided with grooved wheels 765 at its opposite ends.

The suspending body 761 has vertically extending guide slots 763 at its opposite ends. Each of the grooved wheels 765 of the guide rod 762 is slidably received in the corresponding one of the guide slots 763 for movement in an up-down direction. Rail portions 764 extend along the side edges of each of the guide slots 763 so that they can engage with the groove formed on each of the grooved wheels 765 of the guide rod 762. When the grooved wheels 765 of the guide rod 762 are received in the guide slots 763, the guide rod 762 can move in a gravitational direction along the guide slots 763 of the suspending body 761.

FIG. 15 is a partially cut-away exploded perspective view illustrating an alternative bottom weight member of the multiple choice shade system in accordance with the present invention. As shown, the bottom weight member 760' is of an inverted triangular shape and is suspended from the U-shaped bottom end of the shade element 730.

Although not shown in the drawings, the bottom weight member 760 or 760' may have a soft contact portion, at its bottom edge, which suppresses generation of a noise and positively shields the light when the bottom weight member 760 or 760' makes contact with a ground or a floor structure.

As is apparent from the foregoing, the multiple choice shade system of the present invention allows a user to change the color, pattern or material of a shade element at any time in an easy and convenient manner. Furthermore, the shade element can be rapidly extended into or retracted from a target area. In addition, the shade element can be used as a screen for advertisement, public information, or projection, as well as for the shading purpose.

The present application contains subject matter related to the Korean patent applications Nos. KR 2005-0060394, KR 2005-0067394 and KR 2006-0057878, filed in the Korean Patent Office on Jul. 5, 2005, on Jul. 25, 2005, and on Jun. 29, 2006 respectively, the entire contents of which being incorporated herein by references.

While the invention has been shown and described with respect to the preferred embodiments, it will be understood by those skilled in the art that various changes and modification may be made without departing from the spirit and scope of the invention as defined in the following claims.

What is claimed is:

1. A multiple choice shade system, comprising:

a main frame;

a first winding roller rotatably supported on the main frame;

a second winding roller rotatably supported on the main frame in a spaced-apart relationship with the first winding roller;

a multiple choice shade element having a succession of screen sections, the screen sections being composed of at least one planar fabric section and a pleated section, the shade element having a first end fixedly secured to the first winding roller and a second end fixedly secured to the second winding roller, the shade element extending between the first winding roller and the second winding roller in such a manner that one of the screen sections is extended into or retracted from a target area as the first winding roller and the second winding roller are rotated; and an actuator means for rotating at least one of the first winding roller and the second winding roller.

2. The multiple choice shade system as recited in claim 1, wherein the second winding roller is operatively connected to the first winding roller for synchronous rotation with the first winding roller.

3. The multiple choice shade system as recited in claim 2, further comprising a first gear attached to the first winding roller and a second gear attached to the second winding roller, the first gear and the second gear directly meshed with each other for synchronous rotation in opposite directions.

4. The multiple choice shade system as recited in claim 1, wherein the first winding roller and the second winding roller are arranged one below the other and the multiple choice shade element is suspended from the first winding roller and the second winding roller to have a generally U-shaped bottom end.

5. The multiple choice shade system as recited in claim 4, further comprising a weighted guide member hung on the U-shaped bottom end of the multiple choice shade element.

6. The multiple choice shade system as recited in claim 4, further comprising a bottom weight member comprised of a guide rod placed on the U-shaped bottom end of the shade element and a suspending body suspended from the guide rod for relative movement with respect to the guide rod.

7. The multiple choice shade system as recited in claim 6, wherein the guide rod is provided with a wheel and the suspending body has a vertically extending guide slot for slidably receiving the wheel of the guide rod.

8. The multiple choice shade system as recited claim 1, wherein the actuator means comprises a rotating member attached to the second winding roller and a pull cord partially engaging with the rotating member in such a manner that the rotating member is rotated together with the second winding roller as the pull cord is pulled down.

9. The multiple choice shade system as recited claim 1, wherein the actuator means comprises an electric motor unit for rotating the first winding roller and the second winding roller with an electric power.

10. The multiple choice shade system as recited in claim 1, wherein the screen sections of the multiple choice shade element are composed of a plurality of differently looking planar fabric sections.

11. The multiple choice shade system as recited in claim 1, wherein the first winding roller and the second winding roller are arranged one below the other and the multiple choice shade element is suspended from the first winding roller and the second winding roller to have a generally U-shaped bottom end.

12. The multiple choice shade system as recited in claim 11, further comprising a weighted guide member hung on the U-shaped bottom end of the multiple choice shade element.

13. The multiple choice shade system as recited in claim 11, further comprising a bottom weight member comprised of a guide rod placed on the U-shaped bottom end of the shade element and a suspending body suspended from the guide rod for relative movement with respect to the guide rod.

14. The multiple choice shade system as recited in claim 13, wherein the guide rod is provided with a wheel and the suspending body has a vertically extending guide slot for slidably receiving the wheel of the guide rod.

15. A multiple choice shade system, comprising:

a main frame;

a first winding roller rotatably supported on the main frame;

a second winding roller rotatably supported on the main frame in a spaced-apart relationship with the first winding roller;

a multiple choice shade element having a succession of screen sections, the screen sections being composed of at least one planar fabric section and a Roman shade section, the shade element having a first end fixedly secured to the first winding roller and a second end fixedly secured to the second winding roller, the shade element extending between the first winding roller and the second winding roller in such a manner that one of the screen sections is extended into or retracted from a target area as the first winding roller and the second winding roller are rotated; and an actuator means for rotating at least one of the first winding roller and the second winding roller.

16. The multiple choice shade system as recited in claim 15, wherein the second winding roller is operatively connected to the first winding roller for synchronous rotation with the first winding roller.

17. The multiple choice shade system as recited in claim 16, further comprising a first gear attached to the first winding roller and a second gear attached to the second winding roller, the first gear and the second gear directly meshed with each other for synchronous rotation in opposite directions.

18. The multiple choice shade system as recited claim 15, wherein the actuator means comprises a rotating member attached to the second winding roller and a pull cord partially engaging with the rotating member in such a manner that the rotating member is rotated together with the second winding roller as the pull cord is pulled down.

19. The multiple choice shade system as recited claim 15, wherein the actuator means comprises an electric motor unit for rotating the first winding roller and the second winding roller with an electric power.

* * * * *